United States Patent [19]

Blake

[11] 3,981,595

[45] Sept. 21, 1976

[54] DISPENSING PAINT TRIMMER

[76] Inventor: Theodore M. Blake, 801 Farley Drive, Huntsville, Ala. 35802

[22] Filed: May 27, 1975

[21] Appl. No.: 580,550

[52] U.S. Cl. ..... 401/48; 401/179; 401/9

[51] Int. Cl.[2] ..... A46B 11/00

[58] Field of Search ..... 401/9, 179, 15, 48

[56] References Cited

UNITED STATES PATENTS

| | | | |
|---|---|---|---|
| 2,554,571 | 5/1951 | Heishman | 401/15 |
| 2,630,006 | 3/1953 | Leach | 401/179 |
| 3,023,443 | 3/1962 | Brandels | 401/15 X |

*Primary Examiner*—Lawrence Charles
*Attorney, Agent, or Firm*—C. A. Phillips

[57] ABSTRACT

A dispensing paint trimmer for painting one of two walls meeting along a line at a right angle consisting of a pair of guides positioned at right angles and a paint dispenser adapted to apply paint to one of the walls terminating precisely at the intersection of the walls.

2 Claims, 1 Drawing Figure

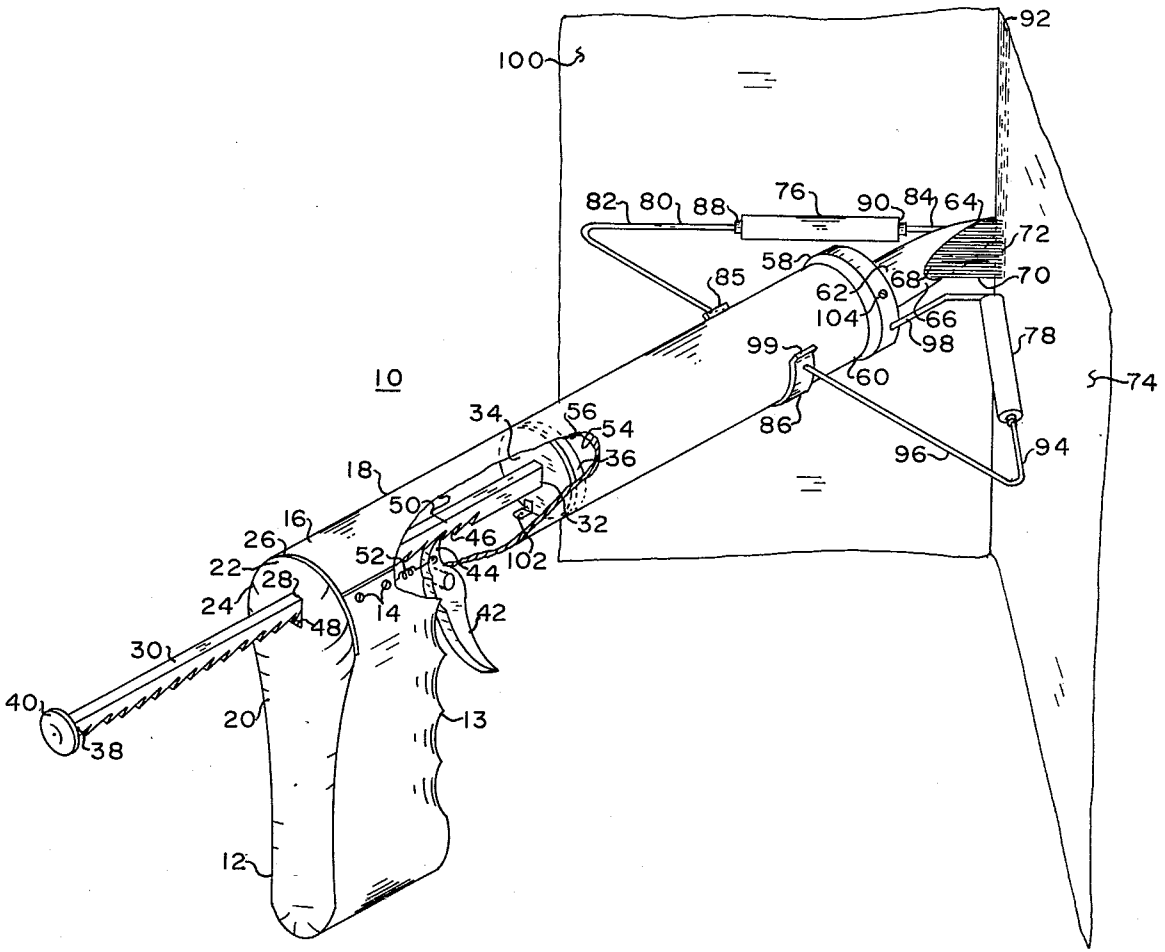
10
12
13
14
16
18
20
22
24
26
28
30
32
34
36
38
40
42
44
46
48
50
52
54
56
58
60
62
64
66
68
70
72
74
76
78
80
82
84
85
86
88
90
92
94
96
98
99
100
102
104

DISPENSING PAINT TRIMMER

BACKGROUND OF THE INVENTION

1. Field of the Invention

This invention relates to paint application devices, and particularly to a device of this category which is particularly adapted to paint up to a line of intersection between a wall and a ceiling or between two walls meeting at a right angle.

2. General Description of the Prior Art

The problem of painting a straight line is difficult, particularly for the non-professional painter. It is a frequent problem where one must paint along a corner line between a wall and a ceiling or between two walls meeting at a right angle. One device employed in the past is a stationary guide held up to the line to be painted and paint applied along and over the guide, with the guide functioning as a mark to prevent paint from spilling over. The difficulty with this type device is that paint invariably gets under the guide and paint does spill over. Another device used for this purpose is a small, tapered sponge roller which, by means of a handle, is rolled along and applies paint to a wall surface. While such a device is effective, it requires considerable care, and is anything but fool-proof. There are still other devices which may be employed for this purpose, but the applicant knows of no device which the novice may employ with assured results.

Accordingly, it is the object of this invention to provide a new and improved paint applicator which may be moved along a corner line between walls or between a wall and a ceiling which will enable one to accurately paint up to the intersection.

SUMMARY OF THE INVENTION

In accordance with the invention, a paint trimmer is constructed having a pair of guide members having wall engaging surfaces along lines meeting at a right angle. One of the guide members is particularly spaced from a corner of the device defined by the intersection of these lines.

BRIEF DESCRIPTION OF THE DRAWING

The drawing in this case is a perspective view of an embodiment of the invention showing it as it would be employed.

DETAILED DESCRIPTION OF THE DRAWING

Referring to the drawing, there is shown a paint trimmer 10 constructed in accordance with the invention. Trimmer 10 includes a hollow handle 12 by which the trimmer is manipulated and which is in the configuration of a pistol grip. In order to provide a firm grip, leading edge 13 of handle 12 is contoured so as to cradle the fingers of the user. Handle 12 is secured as by metal screws 14 to one end region 16 of elongated metal tube 18. Handle 12 extends normal to tube 18, and closing wall 20 of handle 12 is formed into a circular member 22 at one end 24 so as to enclose end 26 of tube 18. A rectangular slot 28 is formed through closing wall 20 of handle 12 which is dimensioned to slidably accept rectangular ratchet bar 30. One end 32 of ratchet bar 30 is centrally attached to piston 34 which is preferably fitted with a pliable packing 36 which forms a slidable seal within the interior periphery of tube 18. While tube 18 may be of various configurations in cross section, it is illustrated here as cylindrical in form. Ratchet bar 30 extends through slot 28 and is terminated at the outer end 38 by a circular knob 40. Linear motion of ratchet bar 30 is effected in the inward direction by trigger 42. At one end trigger 42 is formed into a pawl 44 which is adapted to sequentially engage notches 46 of ratchet bar 30. When the trigger is released, ratchet bar 30 is urged into engagement with pawl 44 and edge 48 of slot 28 by hair pin spring 50 supported at one end by tube 18 and at the opposite end by ratchet bar 30. Trigger 42 is rotated counterclockwise out of engagement with ratchet bar 30 by tension spring 52. A paint reservoir 54 is formed in the interior forward region of tube 18, being closed at one end 56 by piston 34 and at the opposite end by a removable cap 58, which is threadably attached about upper end 60 of tube 18. A pointed nozzle 62 is threadably secured in a central opening (not shown) formed in cap 58. An ovular longitudinal outlet, or slot, 64 is formed through wall 66 of nozzle 62 through which is fitted one end 68 of a paint applicator 70 such as that formed of multiple bristles as illustrated in the drawing. The edges of ovular slot 64 are then crimped to support applicator 70 such that a porous region is provided to the interior of nozzle 62. Surface contacting end 72 of applicator 70 is trimmed so as to apply paint to a surface such as one wall surface 74, as shown in the drawing, when trimmer 10 is positioned at an angle of 45° from the surface. In order to insure that trimmer 10 is supported at the proper angle, trimmer 10 is supported by a pair of rollers 76 and 78 which are displaced by an angle of 90°. One roller 76 is rotatably supported by arm 80 of V-shaped rod 82. Rod 82 is attached at one end 84 to nozzle 62 and at the opposite end is supported near one end 85 of C-shaped spring clip 86. Roller 76 is axially supported by collars 88 which are positioned so that end 90 of roller 76 is spaced from a wall surface so as to clear a freshly painted strip 92, as shown on wall surface 74. The other roller 78 is supported in a similar manner by one arm 94 of a rod member 96 which is formed at one end into bracket 98, which is attached to threaded cap 58. The opposite end is formed inward and is supported near end 99 of spring clip 86, in turn supported by elongated tube 18. With the rollers thus supported at a 90° angle with respect to each other and in a plane through the longitudinal axis of elongated tube 18, tube 18 is supported at an angle of 45° from either wall surface 74 or the wall surface 100. In operation, end cap 58 is removed from tube 18, and ratchet bar 30 is retracted so that piston 34 rests against limit stop 102. Reservoir 54 is then filled with paint and cap 58 threaded over the end of tube 18 so that applicator 70 is positioned at an angle normal to handle 12. In order to secure cap 58 in this position, a set screw 104 would typically be provided through cap 58. Handle 12 is then grasped in an obvious manner, and the forefinger is positioned about trigger 42. Trigger 42 is alternately squeezed and released so as to reduce the volume within cylinder 54 and thus dispense paint into applicator 70. Trimmer 10 is then positioned as shown in the drawing with applicator 70 either in contact with wall surface 74 or at a 180° position wherein the applicator contacts an area to be trimmed along the intersecting edge of wall surface 100. Rollers 76 and 78 are then urged into engagement with wall surfaces 74 and 100. The trimmer is then moved back and forth in a well known manner so as to evenly apply paint along the unpainted region to be trimmed. By observing the thickness of coat being applied to a surface, trigger 42 is manipulated to supply an appropriate quantity of paint to applicator 70 to cover the surface to be painted. Each time the trigger is squeezed, the volume of reservoir 54 is reduced to dispense more paint into the applicator.

Having thus described my invention, what is claimed is:

1. A dispensing paint trimmer for painting one of two walls meeting along a line at a right angle comprising:

a right angle frame, and first and second spaced guide members comprising first and second rollers supported on said frame on perpendicular axes, and each roller having a linear outer wall engaging surface lying along a line 90° apart from the same outer surface of the other roller and thereby adapted to guidably engage surfaces of such walls, said frame including an open region between said second roller and right angle at and corresponding to the intersection of the extension of lines along said surface of said rollers;

a paint dispenser connected to said frame, and having an outlet and paint feed control means for supplying a selected quantity of paint through said outlet; and paint distribution means comprising a plurality of bristles extending from said outlet of said paint dispenser, the ends of said bristles comprising a paint application area extending from said right angle for a selected distance in said open region and along a line which, when extended, engages said outer surface of said second roller.

2. A dispensing paint trimmer as set forth in claim 1 wherein:

said frame comprises a first wire member comprising the axle of said first roller, and a second wire member comprising the axle of said second roller; and said paint dispenser comprises:

an elongated cylinder supporting said axles, and the axis of said cylinder and the axes of said axles lying in a common plane, said outlet is attached to one end of said cylinder, a piston positioned to travel within said cylinder and compress paint between said piston and said outlet, and operating means including a hand-operating control means attached to said piston for selectively compressing said piston toward said outlet, whereby paint may be expelled through said outlet to said bristles.

* * * * *